US007195449B2

(12) United States Patent
Eisenhauer

(10) Patent No.: US 7,195,449 B2
(45) Date of Patent: Mar. 27, 2007

(54) FAN

(75) Inventor: Hartmut Eisenhauer, Michelfeld (DE)

(73) Assignee: Stego-Holding GmbH, Schwabisch Hall (DE)

( * ) Notice: Subject to any disclaimer, the term of this patent is extended or adjusted under 35 U.S.C. 154(b) by 0 days.

(21) Appl. No.: 10/537,383

(22) PCT Filed: Dec. 5, 2003

(86) PCT No.: PCT/EP03/13773

§ 371 (c)(1),
(2), (4) Date: Jun. 3, 2005

(87) PCT Pub. No.: WO2004/051090

PCT Pub. Date: Jun. 17, 2004

(65) Prior Publication Data

US 2006/0034680 A1 Feb. 16, 2006

(30) Foreign Application Priority Data

Dec. 5, 2002 (DE) ..... 102 56 962

(51) Int. Cl.
*F04D 29/00* (2006.01)

(52) U.S. Cl. ..... 415/118; 416/247 R

(58) Field of Classification Search ..... 415/118; 416/247 R; 73/129
See application file for complete search history.

(56) References Cited

U.S. PATENT DOCUMENTS

| | | | |
|---|---|---|---|
| 4,905,511 | A | 3/1990 | Reinhold |
| 5,137,428 | A | 8/1992 | Poll et al. |
| 5,426,975 | A | 6/1995 | Stark |

FOREIGN PATENT DOCUMENTS

| | | |
|---|---|---|
| DE | 198 30 340 | 11/1999 |
| DE | 198 47 454 | 5/2000 |
| DE | 100 04 473 | 8/2001 |
| EP | 0 626 519 | 11/1994 |

OTHER PUBLICATIONS

International Search Report issued in PCT/EP03/13773 dated Apr. 15, 2004.

*Primary Examiner*—Edward K. Look
*Assistant Examiner*—Dwayne J White
(74) *Attorney, Agent, or Firm*—Marshall, Gerstein & Borun LLP

(57) ABSTRACT

The invention relates to a device for generating an air current, in particular for cooling or heating electric components or sub-assemblies. The aim of the invention is to develop a device of this type in order to incorporate an additional air-current monitor in a simple and cost-effective manner, thus ensuring the reliable and accurate monitoring of the ventilation process. The achieve this, the device is provided with an integrated air-current monitor on a housing part, the latter surrounding and/or being allocated to the fan. Said monitor is positioned in such a way that it is situated in the air current.

14 Claims, 1 Drawing Sheet

FAN

RELATED APPLICATIONS

This is the U.S. national phase of International Application No. PCT/EP2003/013773 filed Dec. 5, 2003, the entire disclosure of which is incorporated herein by reference.

FIELD OF DISCLOSURE

The invention relates to a fan assembly for generating an air current, in particular for cooling or heating electric components or sub-assemblies.

BACKGROUND ART

Switch cabinets or similar apparatus that contains electrical and/or electronic components or sub-assemblies are as a rule air-conditioned or actively ventilated. Such enforced ventilation may be necessitated not only by thermal emission from the components themselves but by an unfavorable position of the cabinet, for instance in the vicinity of heat-emitting machines or in surroundings that are too cool for the components or sub-assemblies, because without such ventilation a climate develops inside the cabinet that would endanger the function of the components.

Monitoring of the air current is customarily achieved by monitoring the current supplied to the fan. On one hand this requires relatively elaborate switching technology, while on the other hand it is not very reliable, because it is possible for even a fan supplied with the correct current to be unable to generate a sufficient air current, e.g. when a filter has been inserted.

SUMMARY OF THE DISCLOSURE

It is an object of the present invention to provide a fan assembly for generating an air current in such a way as to enable a ventilation process to be performed reliably and precisely.

This objective is achieved a device according to claim 1.

According to the present invention, there is provided a fan assembly for generating an air current, especially for cooling or warming electrical components or sub-assemblies, comprising a fan, a housing part for the fan, and an integrated air-current monitor disposed such that it is situated within the air current generated by the fan.

It is an aim of the invention that by installation of the fan assembly of the invention that the ventilation process can be carried out in an orderly manner.

Thus in a first preferred embodiment of the invention, the air-current monitor is disposed at a grid that covers the fan. A particular advantage of this arrangement is that the air-current monitor can still be installed even if the fan assembly has already been installed. Because covering grids as a rule are situated at easily accessible places, little effort is required to exchange them for covering grids that comprise an integrated air-current monitor, with no need to dismantle the fan assembly itself. When the covering grid is appropriately mounted according to the present invention, it is easy to keep track of whether the fan is operating perfectly. It is also possible to attach an external air-current monitor to a covering grid that has already been installed, because these grids as a rule are easily accessible.

In such an embodiment, the air-current monitor may be disposed substantially in the same plane as the covering grid. If it is provided for the air-current monitor to be installed on the covering grid, it is advantageous for it to project as slightly as possible above the grid, to minimize the possibility of damage to the air-current monitor, e.g. by the action of an external force. Thus the covering grid protects the monitor and ensures that it will remain functional.

One solution in accordance with the invention provides that the part of the housing that surrounds and/or is associated with the fan be made integral with the covering grid that accommodates the air-current monitor. This enables a further reduction of the costs of manufacturing the housing part and is the simplest means of keeping the air-current monitor in a place where it can reliably measure the air current.

In a special embodiment it is provided that the air-current monitor be disposed on a motor housing of the fan. The special advantage here is that the air-current monitor is contained within the fan device where it is completely protected, which is useful for instance when the apparatus to be ventilated is positioned at sites where an externally mounted air-current monitor could easily be damaged.

Furthermore, it is provided as one of the preferred embodiments that an air-current monitor housing and the housing part that surrounds the fan and/or is associated therewith and integrates the air-current monitor be made in one piece. The integrating housing part then already includes the retaining means that are needed to hold the air-current monitor. Advantages here are both the simple assembly of the integrated monitoring device and the economical manufacture of the integrating housing part.

As an alternative thereto, the above-mentioned integrating housing part can provide at least one aperture designed to accommodate an air-current monitor as an external component. This enables an extremely economical manufacture of the integrating housing part; in the simplest way a possibility is created for receiving the air-current monitor. In addition, the aperture on the covering grid can be constructed with a removable finger protector, so that when the air-current monitor is not attached, the grid can fully perform its protective function.

In a special embodiment the aperture in the housing part described above comprises a receiving mechanism to receive the external air-current monitor. The receiving mechanism can, for example, take the form of a screw arrangement or operate by way of a snap mechanism. This has the advantage that when an air-current monitor is to be used ocasionally, it can very rapidly and reversibly be installed and removed. Hence it can also be installed after assembly of the ventilation device and also removed with no difficulty, for instance if it is needed elsewhere.

One solution in accordance with the invention provides that the air-current monitor is disposed on the blowing side of the ventilator. In switch cabinets, in particular those for data storage, filters are mounted, on the suction side of the ventilators to keep dust and similar contaminants out of the interior of the cabinet. Preferably the air-current monitor is disposed in such a way that the air approaching it has already been filtered, so as to prevent dirt particles from harming the monitoring device.

Other embodiments of the will be apparent from the subordinate claims.

The invention will now be described with reference to exemplary embodiments as shown in the accompanying drawings.

DETAILED DESCRIPTION

Figure 1:
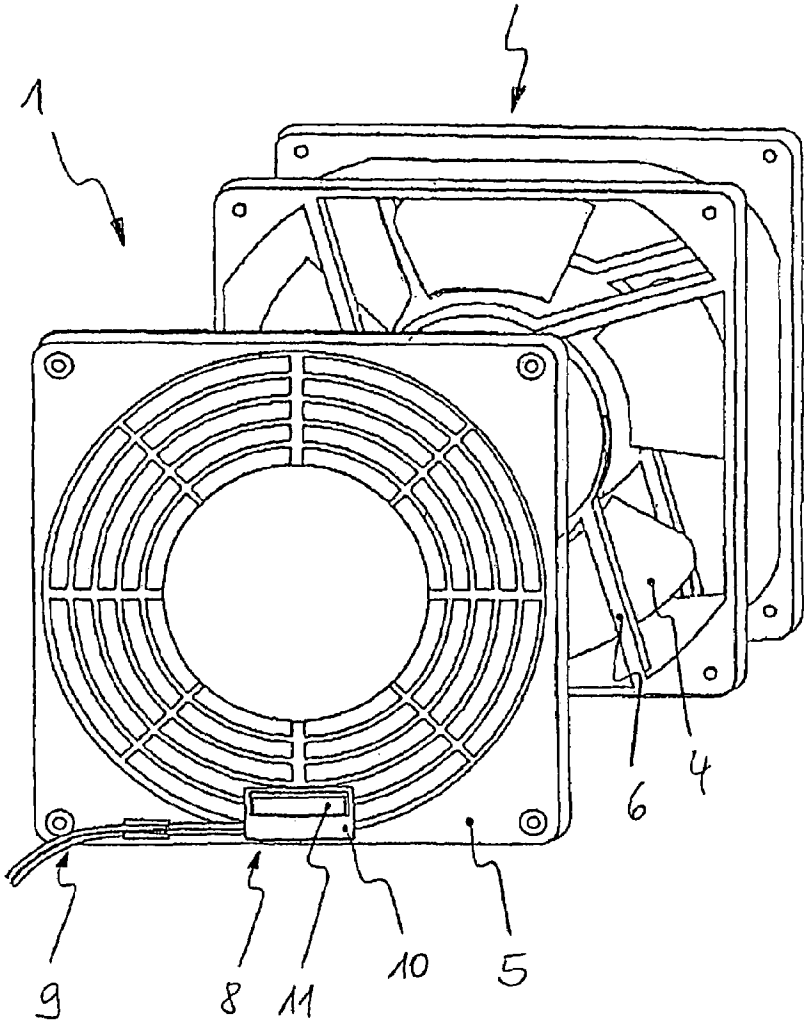
FIG. 1 is an exploded perspective view of a fan assembly in accordance with the invention with an air-current monitor disposed on a covering grid.

FIG. 1 shows a fan assembly 1 according to the invention in perspective, as an exploded drawing. Here an air-current monitor 8 is disposed on a covering grid 5. Possible ways of integrating the air-current monitor 8 are shown in more detail in FIG. 2.

At this juncture the principle of an air-current monitor 8 will briefly be explained in general.

In order to ensure continuous ventilation, air-current monitors. 8 are employed along with the actual ventilation device as control units, to monitor the process of ventilation on the basis of the air supply flow and/or the volumetric air flow. By this means, for example, defects in the ventilators or in added filters as well as generally critical ventilation events can be detected. Air-current monitors 8 are devices comprising a sensor 11 against which an air current to be monitored impinges, and an evaluation unit. For example, by means of the sensor 11 the flow velocity and/or throughput rate of the air current are detected, and if the ventilation situation is found to be critical, the evaluation unit then triggers a warning mechanism. The warning can, e.g., be acoustical or optical.

The air-current monitor 8 can be constructed extremely simply, with a sensor 11 in the form of a pivotably seated flap against which the air-current flows; in this case flow velocity and/or throughput rate of the air current are represented by a change in position of the sensor, which actuates a switch if the change in position is associated with a critical ventilation situation, as a result of which the above-mentioned warning mechanism is triggered.

In the exemplary embodiment presented here the covering grid 5 is provided as an independent component and therefore can be lifted away from a housing part 2 that surrounds the fan 1 and/or is associated therewith. The housing part 2 could also be made integral with the covering grid 5, which accommodates the air-current monitor 8, in order to rationalize the manufacturing process.

Figure 2:
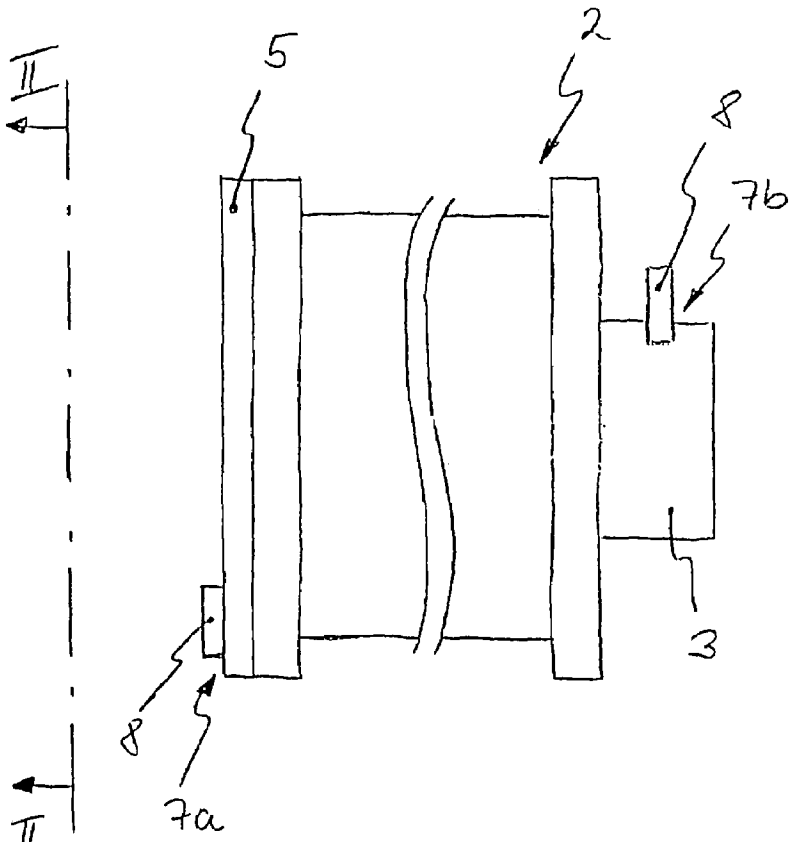
FIG. 2 is a side view of the fan assembly in accordance with the invention along the line II—II in FIG. 1.

FIG. 2 shows a side view of the device 1 in accordance with the invention. The drawing shows more than one possible way to accommodate the air-current monitor 8, although as a rule only one air-current monitor is provided in the device 1.

Once again the possibility of fixing the air-current monitor 8 to the covering grid 5 is displayed. For this purpose the covering grid 5 can include an aperture 7*a*. If the side of the structure, e.g. a switch cabinet, that contains the fan device is easily accessible from the exterior, it is advantageous for the air-current monitor 8 to project as slightly as possible out of the covering grid 5. This reduces the effects of impacts or similar external events on the air-current monitor 8. An integrating housing part 2 with an aperture 7*a* additionally facilitates the (in some cases subsequent) installation of the air-current monitor 8. At times when no air-current monitor 8 is installed here, the aperture 7*a* can be covered by a supplementary, removable finger protector so as to ensure that the grid 5 completely fulfills its protective function.

In order to install an external air-current monitor 8 at the fan device 1, in particular in the above-mentioned apertures 7*a*, 7*b*, these and/or the air-current monitor 8 must comprise a receiving mechanism (not shown here) to keep the air-current monitor 8 in place. This can for example take the form of a screw means, be implemented by a snap mechanism, or offer any other possible means of retaining the air-current monitor 8.

Furthermore, it is possible to accommodate the air-current monitor 8 in the motor housing 3, where it will also be protected. The present drawing shows an aperture 7*b* for this purpose. Mounting of the air-current monitor 8 in the interior of the fan device 1 is preferable when the apparatus to be ventilated is situated at a place where an externally exposed air-current monitor 8 could easily be damaged.

An air-current monitor casing 10 and the housing part 2 that surrounds the fan 1 and/or is associated therewith and integrates the air-current monitor 8 could also be made in one piece. In this case the integrating housing part 2 already contains the holders needed to receive the components of the air-current monitor 8. Simple and economical manufacture of this air-current monitor unit and the possibility of rapid assembly are benefits associated with this exemplary embodiment.

In principle the air-current monitor 8 could also be attached to the brace 6 in the housing part that contains the impeller 4 of the fan. In particular when mounted on the side thereof that faces the covering grid 5, an air-current monitor 8 would be easily accessible and nevertheless protected.

Preferably the air-current monitor 8 is disposed on the blowing side of the fan 1. This arrangement is particularly appropriate when the fan device 1 is additionally equipped with filters (not shown) to protect the components that it ventilates. If the air-current monitor 8 is also exposed to the filtered air, its working life is prolonged and potential maintenance costs are reduced.

The housing components 2 are made of commercially available materials as a rule, for instance of diecast aluminum or UL-permitted polyurethane or -carbonate.

LIST OF REFERENCE NUMERALS

1 Device for generating an air current (fan)
2 Housing
3 Motor housing
4 Impeller
5 Covering grid
6 Brace
7*a* Aperture
7*b* Aperture
8 Air-current monitor
9 Leads
10 Air-current monitor casing
11 Sensor flap

The invention claimed is:

1. Fan assembly for generating an air current for cooling or warming electrical components or sub-assemblies, comprising:

a fan;

a housing part for the fan; and an integrated air-current monitor disposed such that the integrated air-current monitor is situated within the air current generated by the fan, wherein a motor is provided within a motor housing to drive the fan, the air-current monitor being disposed on the motor housing.

2. Fan assembly according to claim 1, wherein a covering grid is provided for the fan.

3. Fan assembly according to claim 2, wherein the air-current monitor is disposed in substantially the same plane as the covering grid.

4. Fan assembly according to claim 2, wherein the housing part and the covering grid are made in one piece.

5. Fan assembly according to claim 1, wherein the air-current monitor is provided with a casing, the housing part for the fan and the casing for the air-current monitor being made in one piece.

6. Fan assembly according to claim 1, wherein the air-current monitor is disposed on the blowing side of the fan.

7. Fan assembly for generating an air current for cooling or warming electrical components or sub-assemblies, comprising:

a fan;

a housing part for the fan; and an integrated air-current monitor disposed such that the integrated air-current monitor is situated within the air current generated by the fan, wherein the housing part for the fan defines at least one aperture to receive the air-current monitor.

8. Fan assembly according to claim 7, wherein a receiving mechanism is provided within the at least one aperture to receive the air-current monitor.

9. Fan assembly according to claim 7, wherein a covering grid is provided for the fan.

10. Fan assembly according to claim 9, wherein the air-current monitor is disposed in substantially the same plane as the covering grid.

11. Fan assembly according to claim 9, wherein the housing part and the covering grid are made in one piece.

12. Fan assembly according to claim 7, wherein a motor is provided within a motor housing to drive the fan, the air-current monitor being disposed on a motor housing.

13. Fan assembly according to claim 7, wherein the air-current monitor is provided with a casing, the housing part for the fan and the casing for the air-current monitor being made in one piece.

14. Fan assembly according to claim 7, wherein the air-current monitor is disposed on the blowing side of the fan.

* * * * *